US009318095B2

(12) United States Patent
Obata et al.

(10) Patent No.: US 9,318,095 B2
(45) Date of Patent: Apr. 19, 2016

(54) ACTIVE VIBRATION NOISE CONTROL DEVICE

(75) Inventors: Kensaku Obata, Kawasaki (JP); Yoshiki Ohta, Sakado (JP); Yoshitomo Imanishi, Fujimi (JP); Akihiro Iseki, Kawasaki (JP)

(73) Assignee: PIONEER CORPORATION, Kanagawa (JP)

( * ) Notice: Subject to any disclaimer, the term of this patent is extended or adjusted under 35 U.S.C. 154(b) by 616 days.

(21) Appl. No.: 13/579,042

(22) PCT Filed: Feb. 18, 2010

(86) PCT No.: PCT/JP2010/052415

§ 371 (c)(1),
(2), (4) Date: Sep. 18, 2012

(87) PCT Pub. No.: WO2011/101967

PCT Pub. Date: Aug. 25, 2011

(65) Prior Publication Data

US 2013/0044891 A1 Feb. 21, 2013

(51) Int. Cl.
*A61F 11/06* (2006.01)
*G10K 11/178* (2006.01)

(52) U.S. Cl.
CPC .... *G10K 11/1786* (2013.01); *G10K 2210/1282* (2013.01); *G10K 2210/3056* (2013.01); *G10K 2210/503* (2013.01)

(58) Field of Classification Search
CPC ..... G10K 11/1786; G10K 2210/106; G10K 2210/121; G10K 2210/128; G10K 2210/1282; G10K 2210/3021; G10K 2210/3035; G10K 2210/30351; G10K 2210/3036; G10K 2210/3054; G10K 2210/3055; G10K 2210/503
See application file for complete search history.

(56) References Cited

U.S. PATENT DOCUMENTS 5,627,896 A * 5/1997 Southward et al. ..... 381/71.11
7,574,006 B2 * 8/2009 Funayama et al. ..... 381/71.12

FOREIGN PATENT DOCUMENTS

| | | | |
|---|---|---|---|
| JP | 04-342296 | 11/1992 | |
| JP | 05-027777 | 2/1993 | |
| JP | 05-232971 | 9/1993 | |
| JP | 06-019485 | 1/1994 | |
| JP | 06035485 A * | 2/1994 | ..... G10K 11/16 |
| JP | 07-230289 | 8/1995 | |
| JP | 08-095577 | 4/1996 | |
| WO | 2007011010 | 1/2007 | |

OTHER PUBLICATIONS

International Search Report PCT/JP2010/052415 dated May 25, 2010, with English translation.

* cited by examiner

*Primary Examiner* — Duc Nguyen
*Assistant Examiner* — Kile Blair
(74) *Attorney, Agent, or Firm* — Young & Thompson

(57) ABSTRACT

The disclosed active vibration noise control device is suitable for use in cancelling out vibration noise by outputting control noise from a plurality of speakers. When a vibration noise frequency is in a dip bandwidth, the active vibration noise control device alters the step size parameters used to update the filter coefficient at at least one filter coefficient update means from among a plurality of filter coefficient update means. Thus, the filter coefficient update speed can be retarded in unstable dip bandwidths, enabling loss in silencing effect which occurs during dip characteristics to be appropriately reduced.

6 Claims, 10 Drawing Sheets

ACTIVE VIBRATION NOISE CONTROL DEVICE

TECHNICAL FIELD

The present invention relates to a technical field for actively controlling a vibration noise by using an adaptive notch filter.

BACKGROUND TECHNIQUE

Conventionally, there is proposed an active vibration noise control device for controlling an engine sound heard in a vehicle interior by a controlled sound output from a speaker so as to decrease the engine sound at a position of passenger's ear. For example, noticing that a vibration noise in a vehicle interior is generated in synchronization with a revolution of an output axis of an engine, there is proposed a technique for canceling the noise in the vehicle interior on the basis of the revolution of the output axis of the engine by using an adaptive notch filter so that the vehicle interior becomes silent, in Patent Reference-1.

By the way, in a narrow vehicle interior environment, there is a case that a deep dip of transfer characteristics from a speaker to a microphone occurs due to a sound wave interference and a reflection in a vehicle interior space. In such a frequency band that the deep dip occurs, an operation of the adaptive notch filter tends to become unstable, and a noise-canceling effect tends to decrease.

For example, in Patent Reference 1, there is proposed a technique for solving the above problem. In Patent Reference 1, there is proposed a technique for switching a speaker to be used in accordance with a noise frequency by using plural speakers. Concretely, the technique verifies transfer characteristics (in other words, amplitude characteristics. The same will apply hereinafter.) of paths related to the speakers, and selects a path of speaker in which an influence of the dip is small.

There are disclosed techniques related to the present invention in Patent References 2 and 3.

PRIOR ART REFERENCE

Patent Reference

Patent Reference-1: International Patent Application Laid-open under No. 2007-011010

Patent Reference-2: Japanese Patent Application Laid-open under No. 04-342296

Patent Reference-3: Japanese Patent Application Laid-open under No. 07-230289

DISCLOSURE OF INVENTION

Problem to be Solved by the Invention

However, by the technique disclosed in Patent Reference-1, an error signal detected by the microphone tends to increase when the speaker to be used is switched. Namely, the noise-canceling effect by the active vibration noise control device tends to decrease. This is because, since the technique uses only one adaptive notch filter, a filter coefficient of the adaptive notch filter is readapted when the speaker is switched. Therefore, the error signal tends to increase due to a discontinuity of a phase change of the filter coefficient when the speaker is switched.

The techniques disclosed in Patent References 2 and 3 do not perform a control in consideration of the above dip characteristics.

The present invention has been achieved in order to solve the above problem. It is an object of the present invention to provide an active vibration noise control device which can appropriately suppress a decrease in a noise-canceling effect during dip characteristics.

Means for Solving the Problem

In the invention according to claim 1, an active vibration noise control device for canceling a vibration noise by making plural speakers output control sounds, includes: a basic signal generating unit which generates a basic signal based on a vibration noise frequency generated by a vibration noise source; plural adaptive notch filters which generate control signals provided to each of the plural speakers by applying filter coefficients to the basic signal, in order to make the plural speakers generate the control sounds so that the vibration noise generated by the vibration noise source is canceled; a microphone which detects a cancellation error between the vibration noise and the control sound, and outputs an error signal; a reference signal generating unit which generates a reference signal from the basic signal based on transfer functions from the plural speakers to the microphone; plural filter coefficient updating units which update the filter coefficients used by each of the plural adaptive notch filters based on the error signal and the reference signal so as to minimize the error signal; and a step-size parameter changing unit which changes a step-size parameter used for updating the filter coefficient of one or more filter coefficient updating units in the plural filter coefficient updating units, when the vibration noise frequency is in such a frequency band that the dip occurs.

DETAILED DESCRIPTION OF THE PREFERRED EMBODIMENTS

Figure 1A:
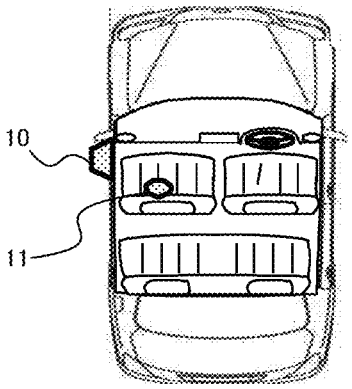
FIGS. 1A to 1C are diagrams for explaining dip characteristics.

According to one aspect of the present invention, there is provided an active vibration noise control device for canceling a vibration noise by making plural speakers output control sounds, including: a basic signal generating unit which generates a basic signal based on a vibration noise frequency generated by a vibration noise source; plural adaptive notch filters which generate control signals provided to each of the plural speakers by applying filter coefficients to the basic signal, in order to make the plural speakers generate the control sounds so that the vibration noise generated by the vibration noise source is canceled; a microphone which detects a cancellation error between the vibration noise and the control sound, and outputs an error signal; a reference signal generating unit which generates a reference signal from the basic signal based on transfer functions from the plural speakers to the microphone; plural filter coefficient updating units which update the filter coefficients used by each of the plural adaptive notch filters based on the error signal and the reference signal so as to minimize the error signal; and a step-size parameter changing unit which changes a step-size parameter used for updating the filter coefficient of one or more filter coefficient updating units in the plural filter coefficient updating units, when the vibration noise frequency is in such a frequency band that the dip occurs.

The above active vibration noise control device is preferably used for canceling the vibration noise (for example, vibration noise from engine) by making the plural speakers generate the control sounds. The basic signal generating unit generates the basic signal based on the vibration noise frequency generated by the vibration noise source. The adaptive notch filters are provided for the plural speakers and generate the control signals provided to the plural speakers by applying the filter coefficients to the basic signal. The microphone detects the cancellation error between the vibration noise and the control sound, and outputs the error signal. The reference signal generating unit generates the reference signal from the basic signal based on the transfer functions from the speakers to the microphone. The plural filter coefficient updating units are provided for the plural speakers and update the filter coefficients used by the plural adaptive notch filters so as to minimize the error signal. Then, the step-size parameter changing unit changes the step-size parameter used for updating the filter coefficient of one or more filter coefficient updating units in the plural filter coefficient updating units, when the vibration noise frequency is in such a frequency band that the dip occurs (hereinafter, the frequency band is referred to as "dip band"). Therefore, in an unstable dip band, it is possible to set an update rate of the filter coefficient of the filter coefficient updating unit to an appropriate rate. Hence, it becomes possible to appropriately suppress the decrease in the noise-canceling effect (in other words, a decrease in a reduction effect of the vibration noise) during the dip characteristics.

In another manner of the above active vibration noise control device, when the vibration noise frequency is in the frequency band, the step-size parameter changing unit changes the step-size parameter to a value which is smaller than a basic step-size parameter used when the vibration noise frequency is not in the frequency band.

According to the above manner, it is possible to delay the update rate of the filter coefficient of the filter coefficient updating unit in the dip band. Namely, it is possible to suppress an excess following of the adaptive notch filter and the filter coefficient updating unit. Therefore, it becomes possible to suppress the decrease in the noise-canceling effect during the dip characteristics more effectively.

In another manner of the above active vibration noise control device, only for a speaker in the plural speakers which has such a frequency band that amplitude characteristics of the transfer functions are equal to or smaller than a predetermined value, the step-size parameter changing unit changes the step-size parameter for updating the filter coefficient used by the adaptive notch filter which generates the control signal of the speaker.

According to the above manner, the step-size parameter changing unit changes the step-size parameter only for the path of the speaker in which the dip tends to occur, and does not change the step-size parameter for the path of the speaker in which the dip hardly occur. Therefore, it becomes possible to suppress a needless delay of the update of the filter coefficient.

In another manner of the above active vibration noise control device, only for a speaker in the plural speakers which is arranged adjacent to the microphone, the step-size parameter changing unit changes the step-size parameter for updating the filter coefficient used by the adaptive notch filter which generates the control signal of the speaker.

According to the above manner, the step-size parameter changing unit treats the speaker arranged adjacent to the microphone, as the speaker by which the dip tends to occur. Then, the step-size parameter changing unit changes the step-size parameter only for the path of the speaker which is arranged adjacent to the microphone, and does not change the step-size parameter for the path of the speaker which is not arranged adjacent to the microphone. Therefore, it becomes possible to suppress a needless delay of the update of the filter coefficient.

Preferably, the above active vibration noise control device includes a dip band determining unit which determines that a predetermined frequency band is such a frequency band that the dip occurs, based on amplitude characteristics of an output sound from the speaker, and a storage unit which stores the predetermined frequency band determined by the dip band determining unit, wherein the step-size parameter changing unit uses the predetermined frequency band stored in the storage unit, as such a frequency band that the dip occurs.

In a preferred example of the above active vibration noise control device, the step-size parameter changing unit sequentially compares amplitude information related to each of the transfer functions from the plural speakers to the microphone which is preliminarily stored for each frequency with a predetermined threshold value, and uses a frequency band in which the amplitude information is below the threshold value, as such a frequency band that the dip occurs.

In a preferred example of the above active vibration noise control device, the step-size parameter changing unit uses a frequency band in which amplitude characteristics of the transfer functions are equal to or smaller than a predetermined value, as such a frequency band that the dip occurs.

In a preferred example of the above active vibration noise control device, with regard to amplitude characteristics of the transfer functions, the step-size parameter changing unit uses a value in accordance with a difference between an amplitude in such a frequency band that the dip occurs and an amplitude in such a frequency band that the dip does not occur, as a changed value of the step-size parameter. Therefore, it is possible to change the step-size parameter to an appropriate value. Hence, it becomes possible to update the filter coefficient at an appropriate rate.

Embodiment

Preferred embodiment of the present invention will be explained hereinafter with reference to the drawings.

[Dip Characteristics]

First, a description will be given of dip characteristics, with reference to FIGS. 1A to 1C. Here, as an example, a conventional active vibration noise control device having a speaker 10 and a microphone 11 is shown in FIG. 1A. The active vibration noise control device is mounted on a vehicle. The speaker 10 is installed on the front side in the vehicle interior, and the microphone 11 is installed on the passenger's side.

The conventional active vibration noise control device makes the speaker 10 generate the control sound based on the frequency in accordance with the revolution of the engine output axis so as to actively control the vibration noise of the engine as the vibration noise source. Concretely, the active vibration noise control device feeds back the error signal detected by the microphone 11 and minimizes the error by using the adaptive notch filter so as to actively control the vibration noise.

Figure 1B:
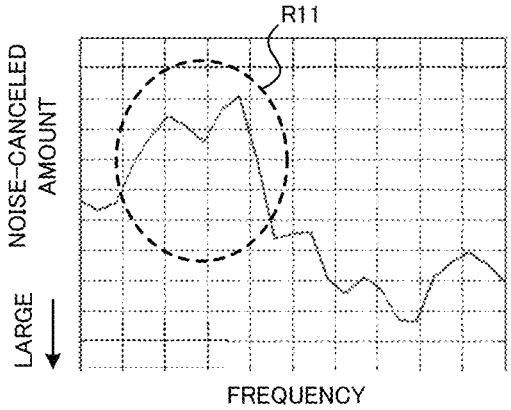

FIG. 1B shows a result example of a process by the above conventional active vibration noise control device. Here, as an example, a result in case of using an artificial engine noise (sweep signal) is shown. FIG. 1B is a diagram showing a noise-canceling effect by the above conventional active vibration noise control device. In FIG. 1B, a horizontal axis shows a frequency, and a vertical axis shows a noise-canceled amount. The noise-canceled amount becomes large on the lower side of the vertical axis. Namely, the noise-canceling effect becomes large (The same will apply hereinafter). The noise-canceled amount is an amount corresponding to an amplitude of the error signal detected by the microphone 11.

Figure 1C:
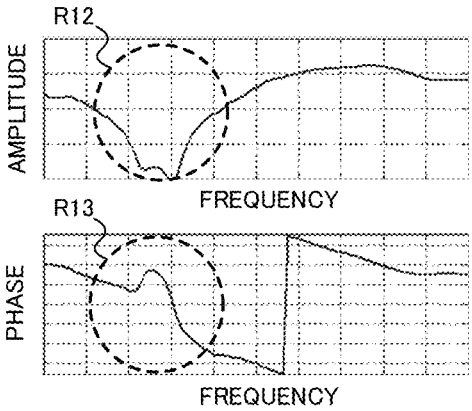

FIG. 1C is a diagram showing transfer characteristics (amplitude characteristics) in case of using the above paths. Concretely, in FIG. 1C, a vertical axis in an upper graph shows an amplitude of the speaker 10, and a vertical axis in a lower graph shows a phase. Additionally, a horizontal axe in each graph shows a frequency.

In a frequency band shown by a dashed area R11 in FIG. 1B, it can be understood that the noise-canceled amount significantly decreases. Additionally, in a frequency band shown by dashed areas R12 and R13 in FIG. 1C, it can be understood that the amplitude decreases and phase characteristics unnaturally change. Namely, in the above frequency band, it can be said that a relatively large dip occurs. When the dip occurs, there is a tendency that a control signal output increases and an operation of the adaptive notch filter becomes unstable. Then, when the operation of the adaptive notch filter becomes unstable, there is a possibility that the noise increases and diverges.

Active Vibration Noise Control Device in Embodiment

Active vibration noise control device in an embodiment performs a process for appropriately suppressing the decrease in the noise-canceling effect during the above dip characteristics.

Figure 2:
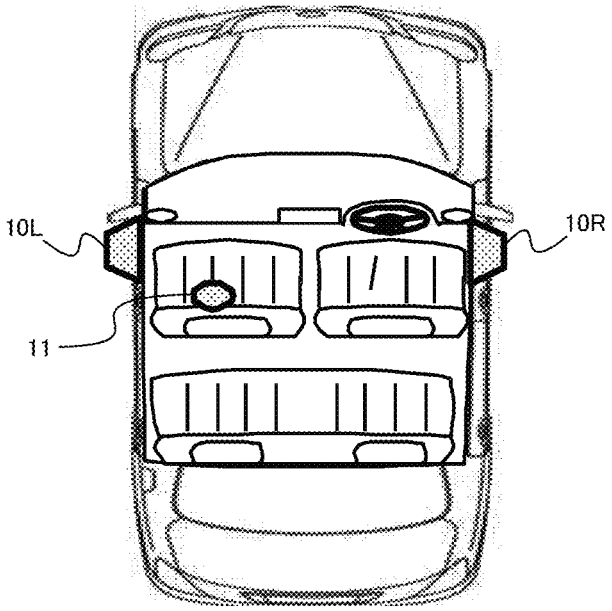
FIG. 2 shows an example of a vehicle on which an active vibration noise control device in an embodiment is mounted.

The embodiment shows such an example that an active vibration noise control device having two speakers 10L and 10R and a microphone 11 which are installed in the vehicle as shown in FIG. 2. The speakers 10L and 10R are installed on the front side in the vehicle interior, and the microphone 11 is installed on the passenger's side. Concretely, the speaker 10L is installed on the front left side, and the speaker 10R is installed on the front right side. Hereinafter, the speaker 10L is expressed as "FL", and the speaker 10R is expressed as "FR", and the microphone 11 is expressed as "E".

Figure 3:
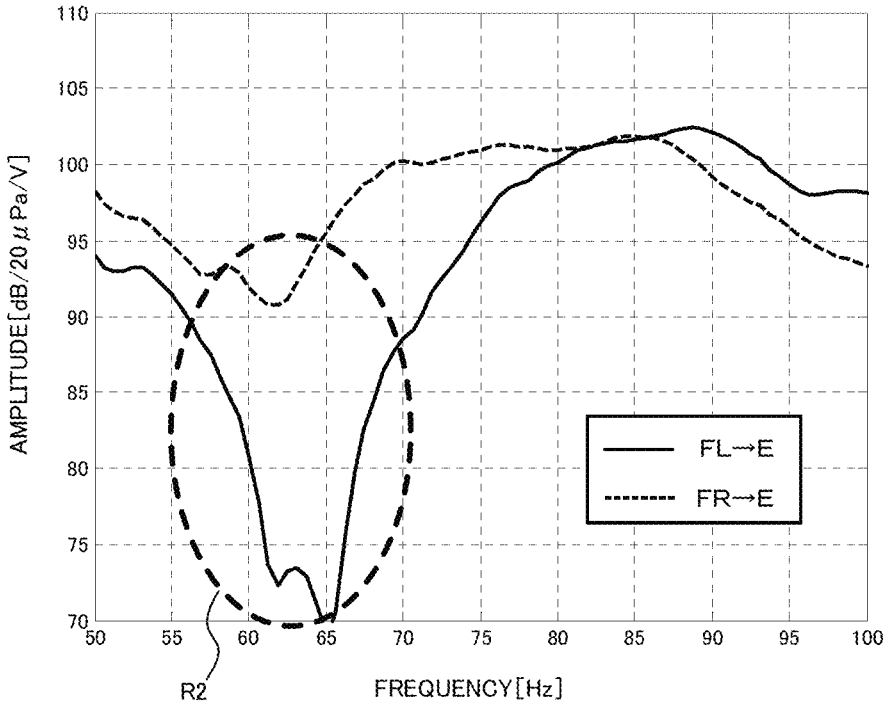
FIG. 3 shows an example of transfer characteristics of paths.

FIG. 3 shows transfer characteristics of paths (paths from the speakers 10L and 10R to the microphone 11) in the above configuration.

In FIG. 3, a horizontal axis shows a frequency [Hz], and a vertical axis shows amplitude characteristics [dB/20 μPa/V]. Additionally, a solid line shows transfer characteristics of a path (FL→E) from the speaker 10L to the microphone 11, and a broken line shows transfer characteristics of a path (FR→E) from the speaker 10R to the microphone 11.

As shown in FIG. 3, with regard to the path from the speaker 10L to the microphone 11, it can be understood that the significant decrease in the amplitude occurs in a frequency band shown by a dashed area R2 (concretely, from about 55 [Hz] to 70 [Hz]). Namely, it can be said that the relatively large dip occurs. In contrast, with regard to the path from the speaker 10R to the microphone 11, it can be understood that the above significant decrease in the amplitude does not occur.

In response to the above result, such an example that the active vibration noise control device which performs a process for dealing with the dip only for the path from the speaker 10L to the microphone 11 is shown hereinafter. Namely, with regard to the path from the speaker 10R to the microphone 11, the active vibration noise control device does not perform the process for dealing with the dip.

Figure 4:
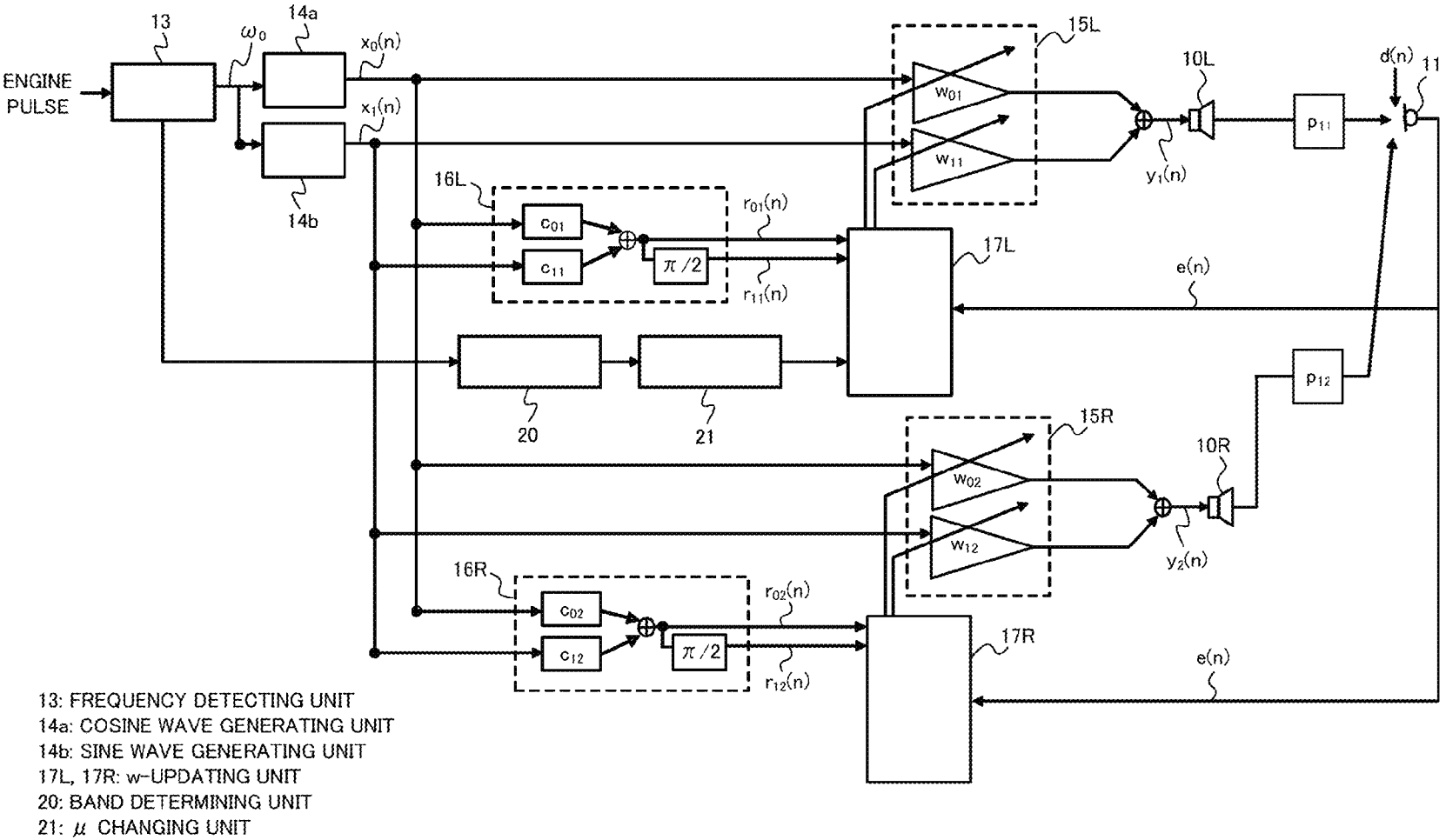
FIG. 4 is a configuration of an active vibration noise control device in an embodiment.

FIG. 4 shows a configuration example of an active vibration noise control device 50 in the embodiment.

The active vibration noise control device 50 in the embodiment includes speakers 10L and 10R, a microphone 11, a frequency detecting unit 13, a cosine wave generating unit 14*a*, a sine wave generating unit 14*b*, adaptive notch filters 15L and 15R, reference signal generating units 16L and 16R, w-updating units 17L and 17R, a band determining unit 20 and a μ changing unit 21.

The active vibration noise control device 50 is mounted on the vehicle, as shown in FIG. 2. Concretely, the speaker 10L and the speaker 10R are installed on the front left side and the front right side in the vehicle interior, respectively. The microphone 11 is installed on the passenger's side. Hereinafter, with regard to the speakers 10L and 10R, the adaptive notch filters 15L and 15R, the reference signal generating units 16L and 16R and the w-updating units 17L and 17R, "L" and "R" are given to the reference numeral when it is necessary to distinguish right from left. In contrast, "L" and "R" are omitted when it is not necessary to distinguish right from left.

In response to the result as shown in FIG. 3, only for the path from the speaker 10L to the microphone 11, the active vibration noise control device 50 performs the process for dealing with the dip. Concretely, the band determining unit 20 and the μ changing unit 21 for dealing with the dip are provided only on the path in which the process for generating a control signal $y_1(n)$ used by the speaker 10L is performed.

Here, a brief description will be given of the process for dealing with the above dip characteristics, which is performed by the active vibration noise control device 50 in the embodiment. When a frequency $\omega_0$ of the engine pulse is within a frequency band (dip band) in which the dip occurs, the active vibration noise control device 50 changes a step-size parameter μ for updating a filter coefficient used by the adaptive notch filter 15L which generates the control signal $y_1(n)$ of the speaker 10L. Concretely, the μ changing unit 21 in the active vibration noise control device 50 changes the step-size parameter μ for updating the filter coefficient used by the w-updating unit 17L.

Specifically, when the frequency $\omega_0$ is in the dip band, the active vibration noise control device 50 sets the step-size parameter μ to a value which is smaller than a value used when the frequency $\omega_0$ is not in the dip band. Therefore, in the unstable dip band, it is possible to delay an update rate of the filter coefficient of the w-updating unit 17L. Namely, it is possible to suppress an excess following of the adaptive notch filter 15L and the w-updating unit 17L. Hence, it becomes possible to appropriately suppress the decrease in the noise-canceling effect during the dip characteristics.

Next, a concrete description will be given of the components in the active vibration noise control device 50. The frequency detecting unit 13 is supplied with an engine pulse and detects a frequency $\omega_0$ of the engine pulse. Then, the frequency detecting unit 13 supplies the cosine wave generating unit 14*a* and the sine wave generating unit 14*b* with a signal corresponding to the frequency $\omega_0$.

The cosine wave generating unit 14*a* and the sine wave generating unit 14*b* generate a basic cosine wave $x_0(n)$ and a basic sine wave $x_1(n)$ which include the frequency $\omega_0$ detected by the frequency detecting unit 13. Concretely, as shown by equations (1) and (2), the cosine wave generating unit 14*a* and the sine wave generating unit 14*b* generate the basic cosine wave $x_0(n)$ and the basic sine wave $x_1(n)$. In the equations (1) and (2), "n" is natural number and corresponds to time (The same will apply hereinafter). Additionally, "A" indicates amplitude, and "φ" indicates an initial phase.

$$x_0(n)=A\cos(\omega_0 n+\phi) \tag{1}$$

$$x_1(n)=A\sin(\omega_0 n+\phi) \tag{2}$$

Then, the cosine wave generating unit 14*a* and the sine wave generating unit 14*b* supply the adaptive notch filters 15 and the reference signal generating units 16 with basic signals corresponding to the basic cosine wave $x_0(n)$ and the basic sine wave $x_1(n)$. Thus, the cosine wave generating unit 14*a* and the sine wave generating unit 14*b* correspond to an example of the basic signal generating unit.

The adaptive notch filters 15L and 15R perform the filter process of the basic cosine wave $x_0(n)$ and the basic sine wave $x_1(n)$, so as to generate the control signals $y_1(n)$ and $y_0(n)$ supplied to the speakers 10L and 10R. Concretely, the adaptive notch filter 15L generates the control signal $y_1(n)$ based on the filter coefficients $w_{01}(n)$ and $w_{11}(n)$ inputted from the w-updating unit 17L, and the adaptive notch filter 15R generates the control signal $y_2(n)$ based on the filter coefficients $w_{02}(n)$ and $w_{12}(n)$ inputted from the w-updating unit 17R. Specifically, as shown by equation (3), the adaptive notch filter 15L adds a value obtained by multiplying the basic cosine wave $x_0(n)$ by the filter coefficient $w_{01}(n)$, to a value by multiplying the basic sine wave $x_1(n)$ by the filter coefficient $w_{11}(n)$, so as to calculate the control signal $y_1(n)$. Similarly, as shown by equation (4), the adaptive notch filter 15R adds a value obtained by multiplying the basic cosine wave $x_0(n)$ by the filter coefficient $w_{02}(n)$, to a value by multiplying the basic sine wave $x_1(n)$ by the filter coefficient $w_{12}(n)$, so as to calculate the control signal $y_2(n)$.

$$y_1(n)=w_{01}(n)x_0(n)+w_{11}(n)x_1(n) \tag{3}$$

$$y_2(n)=w_{02}(n)x_0(n)+w_{12}(n)x_1(n) \tag{4}$$

The speakers 10L and 10R generate the control sounds corresponding to the control signals $y_1(n)$ and $y_2(n)$ inputted from the adaptive notch filters 15L and 15R, respectively. The control sounds generated by the speakers 10L and 10R are transferred to the microphone 11. Transfer functions from the speakers 10L and 10R to the microphone 11 are represented by "$p_{11}$" and "$p_{12}$", respectively. The transfer functions $p_{11}$ and $p_{12}$ rec and frequency $\omega_0$, and depend on the sound field characteristics and the distance from the speakers 10L and 10R to the microphone 11. For example, the transfer functions $p_{11}$ and $p_{12}$ are preliminarily set by a measurement in the vehicle interior.

The microphone 11 detects the cancellation error between the vibration noise of the engine and the control sounds generated by the speakers 10L and 10R, and supplies the w-updating units 17L and 17R with the cancellation error as the error signal e(n). Concretely, the microphone 11 outputs the error signal e(n) in accordance with the control signals $y_1(n)$ and $y_2(n)$, the transfer functions $p_{11}$ and $p_{12}$ and the vibration noise d(n) of the engine.

The reference signal generating units 16L and 16R generate the reference signals from the basic cosine wave $x_0(n)$ and the basic sine wave $x_1(n)$ based on the above transfer functions $p_{11}$ and $p_{12}$, and supplies the w-updating units 17L and 17R with the reference signals. Concretely, the reference signal generating unit 16L uses a real part $c_{01}$ and an imaginary part $c_{11}$ of the transfer function $p_{11}$, and the reference signal generating unit 16R uses a real part $c_{02}$ and an imaginary part $c_{12}$ of the transfer function $p_{12}$. Specifically, the reference signal generating unit 16L adds a value obtained by multiplying the basic cosine wave $x_0(n)$ by the real part $c_{01}$ of the transfer function $p_{11}$, to a value obtained by multiplying the basic sine wave $x_1(n)$ by the imaginary part $c_{11}$ of the transfer function $p_{11}$, and outputs a value obtained by the addition as the reference signal $r_{01}(n)$. In addition, the reference signal generating unit 16L delays the reference signal $r_{01}(n)$ by "π/2", and outputs the delayed signal as the reference signal $r_{11}(n)$. Similarly, the reference signal generating unit 16R adds a value obtained by multiplying the basic cosine wave $x_0(n)$ by the real part $c_{02}$ of the transfer function $p_{12}$, to a value obtained by multiplying the basic sine wave $x_1(n)$ by the imaginary part $c_{12}$ of the transfer function $p_{12}$, and outputs a value obtained by the addition as the reference signal $r_{02}(n)$. In addition, the reference signal generating unit 16R delays the reference signal $r_{02}(n)$ by "π/2", and outputs the delayed signal as the reference signal $r_{12}(n)$. Thus, the reference signal generating units 16L and 16R correspond to an example of the reference signal generating unit.

The w-updating units 17L and 17R update the filter coefficients used by the adaptive notch filters 15L and 15R based on the LMS (Least Mean Square) algorism, and supplies the adaptive notch filters 15L and 15R with the updated filter coefficients. Basically, the w-updating units 17L and 17R update the filter coefficients used by the adaptive notch filters 15L and 15R last time so as to minimize the error signal e(n), based on the error signal e(n) and the reference signals $r_{01}(n)$, $r_{11}(n)$, $r_{02}(n)$ and $r_{12}(n)$. Thus, the w-updating units 17L and 17R correspond to an example of the filter coefficient updating unit.

The filter coefficients before the update of the w-updating unit 17L are expressed as "$w_{01}(n)$" and "$w_{11}(n)$", and the filter coefficients after the update of the w-updating unit 17L are expressed as "$w_{01}(n+1)$" and "$w_{11}(n+1)$". As shown by equations (5) and (6), the filter coefficients after the update $w_{01}(n+1)$ and $w_{11}(n+1)$ are calculated.

$$w_{01}(n+1)=w_{01}(n)-\mu\cdot e(n)\cdot r_{01}(n) \tag{5}$$

$$w_{11}(n+1)=w_{11}(n)-\mu\cdot e(n)\cdot r_{11}(n) \tag{6}$$

Similarly, the filter coefficients before the update of the w-updating unit 17R are expressed as "$w_{02}(n)$" and "$w_{12}(n)$", and the filter coefficients after the update of the w-updating unit 17R are expressed as "$w_{02}(n+1)$" and "$w_{12}(n+1)$". As shown by equations (7) and (8), the filter coefficients after the update $w_{02}(n+1)$ and $w_{12}(n+1)$ are calculated.

$$w_{02}(n+1)=w_{02}(n)-\mu\cdot e(n)\cdot r_{02}(n) \tag{7}$$

$$w_{12}(n+1)=w_{12}(n)-\mu\cdot e(n)\cdot r_{12}(n) \tag{8}$$

In equations (5) to (8), "μ" is a coefficient called a step-size parameter for determining a convergence speed. In other words, the step-size parameter μ is a coefficient related to an update rate of the filter coefficient. For example, a preliminarily set value is used as the step-size parameter μ. Basically, the w-updating unit 17R uses a fixed value as the step-size parameter μ. Namely, the w-updating unit 17R continues to use the preliminarily set value. In contrast, the w-updating unit 17L used a changed value when the μ changing unit 21 changes the step-size parameter μ, and the w-updating unit 17L used the preliminarily set value when the μ changing unit 21 does not change the step-size parameter μ. Hereinafter, the preliminarily set step-size parameter μ is referred to as "basic step-size parameter μ", and the value obtained by changing the basic step-size parameter μ is referred to as "changed step-size parameter μ".

The band determining unit 20 performs the determination of the frequency $\omega_0$ detected by the frequency detecting unit 13. Concretely, the band determining unit 20 determines whether or not the frequency $\omega_0$ of the engine pulse is in the dip band. Then, the band determining unit 20 supplies the μ changing unit 21 with the determination result. For example, the band determining unit 20 uses the dip band which is determined by preliminarily measuring the transfer characteristics of the paths, so as to perform the above determination. As an example, information related to the determined dip band is stored in a band table, and the band determining unit 20 refers to the table so as to perform the above determination.

The μ changing unit 21 changes the basic step-size parameter μ based on the determination result of the band determining unit 20. Concretely, the μ changing unit 21 changes the basic step-size parameter μ when the band determining unit 20 determines that the frequency $\omega_0$ is in the dip band, and the μ changing unit 21 does not change the basic step-size parameter μ when the band determining unit 20 determines that the frequency $\omega_0$ is not in the dip band. In this case, when the band determining unit 20 determines that the frequency $\omega_0$ is in the dip band, the μ changing unit 21 calculates the changed step-size parameter μ' which is smaller than the basic step-size parameter μ. In such a case that the basic step-size parameter μ is changed by the μ changing unit 21, the changed step-size parameter μ' is used for updating the filter coefficient of the w-updating unit 17L. In contrast, in such a case that the basic step-size parameter μ is not changed by the μ changing unit 21, the basic step-size parameter μ is used for updating the filter coefficient of the w-updating unit 17L. Thus, the band determining unit 20 and the μ changing unit 21 correspond to an example of the step-size parameter changing unit.

For example, the μ changing unit 21 uses a parameter (hereinafter referred to as "parameter for change α") for changing the basic step-size parameter μ, so as to calculate the changed step-size parameter μ'. In this case, the μ changing unit 21 calculates the changed step-size parameter μ' by using an equation "μ'=μ*α". As an example, with regard to the amplitude characteristics of the transfer functions, the parameter for change α is set based on a difference between an amplitude in the dip band and an amplitude in the frequency band other than the dip band. Namely, the parameter for change α is set based on a degree of the decrease in the amplitude within the dip band.

[Determination Method of Dip Band]

Next, a description will be given of an example of a determination method of the dip band, with reference to FIG. 5. Here, such an example that the amplitude characteristics of the speakers 10 (in other words, the transfer characteristics of the path) are measured and the dip band is determined based on the measured amplitude characteristics will be given.

Figure 5:
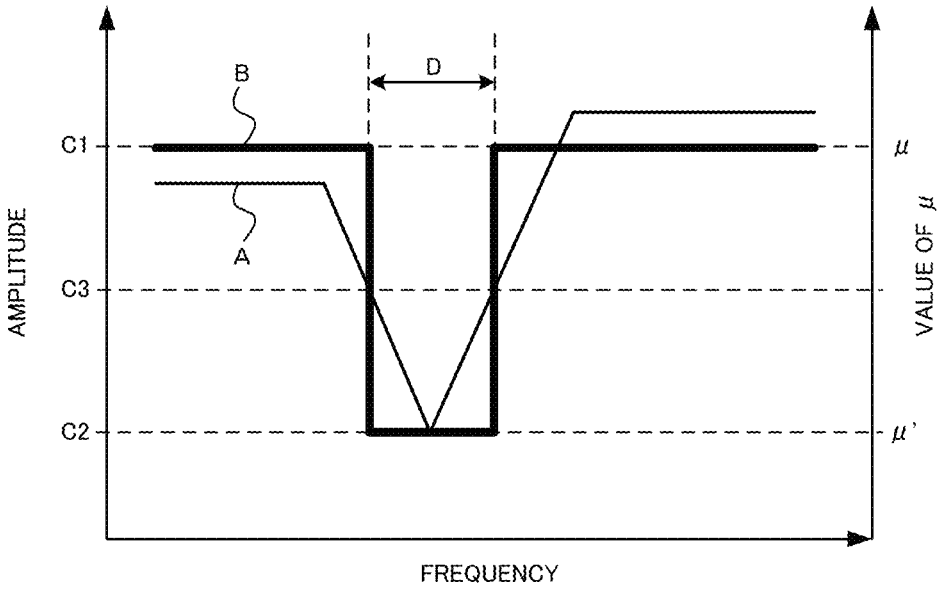
FIG. 5 shows a diagram for explaining an example of a determination method of a dip band.

In FIG. 5, a horizontal axis shows a frequency, and a vertical axis shows an amplitude and a value of the step-size parameter μ. Concretely, a graph A schematically shows the amplitude characteristics obtained by a measurement, and a graph B shows the step-size parameter μ. For example, the graph A corresponds to a graph schematically showing the transfer characteristics (see FIG. 3) of the path from the speaker 10L to the microphone 11.

In FIG. 5, an amplitude C1 shows an average amplitude within the frequency band (for example, from 50 [Hz] to 100 [Hz]) in which the engine pulse is actively controlled, and an amplitude C2 shows an amplitude when the deepest dip occurs. Additionally, an amplitude C3 shows an average amplitude of the amplitude C1 and the amplitude C2. In the embodiment, the frequency band in which the amplitude is equal to or smaller than the amplitude C3 is determined as the dip band. With regard to the example shown in FIG. 5, a frequency band shown by a reference numeral D is determined as the dip band. The determined dip band D is stored in a storage unit such as a memory.

Then, in the embodiment, the step-size parameter μ is changed in the above determined dip band D. Namely, in the embodiment, the step-size parameter μ is changed by using the dip band D stored in the storage unit. With regard to the example shown in FIG. 5, as shown by the graph B, the changed step-size parameter μ' is used in the dip band D, and the basic step-size parameter μ is used in the frequency band other than the dip band D. For example, the parameter for change α [dB] is set based on a difference between the amplitude C1 and the amplitude C2, and a gain of the basic step-size parameter μ is adjusted in accordance with the parameter for change α so as to obtain the changed step-size parameter μ'. As an example, when the amplitude characteristics shown in FIG. 3 are obtained, the changed step-size parameter μ' being one-fifth of the basic step-size parameter μ is calculated.

It is not limited that the amplitude C3 being the average of the amplitude C1 and the amplitude C2 is used for determining the dip band. Namely, it is not limited that the amplitude C3 is used as a threshold value for determining the dip band. A value other than the amplitude C3 may be used as the threshold value for determining the dip band, if the value exists between the amplitude C1 and the amplitude C2.

Additionally, it is not limited that the amplitude characteristics (the transfer characteristics of the path) are measured and the dip band is determined based on the measured amplitude characteristics. As another example, the dip band can be determined by using amplitude information (corresponding to information related to the amplitude characteristics) related to the transfer functions from the speakers 10 to the microphone 11 which is preliminarily stored for each frequency. Concretely, by sequentially comparing the amplitude value included in the amplitude information with a predetermined value, the frequency band in which the amplitude value is below the predetermined value can be used as the dip band. In such a case that the amplitude information related to the transfer functions is not preliminarily stored (for example, in such a case that only phase information is stored), the above method according to another example cannot be applied.

Furthermore, while the above embodiment shows such an example that the fixed value is used as the changed step-size parameter μ' (see FIG. 5), the changed step-size parameter μ' may be changed. For example, the changed step-size parameter μ' may be changed in accordance with a frequency in the dip band. Namely, the changed step-size parameter μ' may be changed in accordance with an amplitude value in the dip band.

[Process for Changing Step-Size Parameter]

Figure 6:
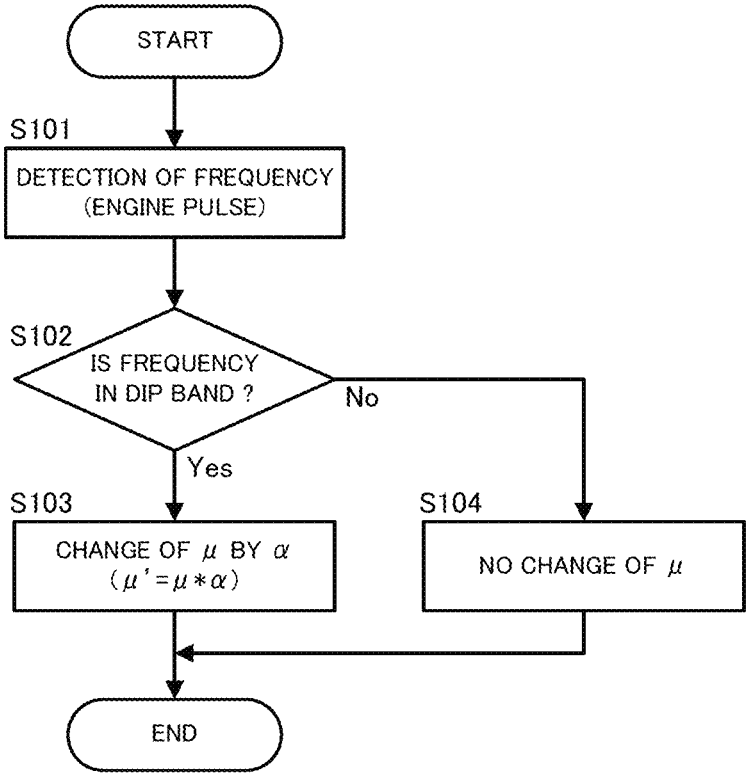
FIG. 6 is a flow chart showing a process for changing a step-size parameter in an embodiment.

Next, a description will be given of an example of a process for changing the step-size parameter in the embodiment, with reference to FIG. 6. FIG. 6 is a flow chart showing the process for changing the step-size parameter in the embodiment. This process is executed by the components in the active vibration noise control device 50, in a predetermined cycle.

First, in step S101, the frequency detecting unit 13 in the active vibration noise control device 50 detects the frequency $\omega_0$ of the inputted engine pulse. The frequency detecting unit 13 supplies the band determining unit 20 with the detected frequency $\omega_0$. Then, the process goes to step S102.

In step S102, the band determining unit 20 in the active vibration noise control device 50 determines whether or not the frequency $\omega_0$ detected by the frequency detecting unit 13 is in the dip band. For example, the band determining unit 20 uses the dip band which is preliminarily obtained by measuring the transfer characteristics of the paths. When the frequency $\omega_0$ is in the dip band (step S102: Yes), the process goes to step S103.

In step S103, the μ changing unit 21 in the active vibration noise control device 50 changes the basic step-size parameter μ. Concretely, the μ changing unit 21 multiplies the basic step-size parameter μ by the parameter for change $\alpha(\mu'=\mu*\alpha)$, in order to calculate the changed step-size parameter μ'. Then, the process ends.

Meanwhile, when the frequency $\omega_0$ is not in the dip band (step S102: No), the process goes to step S104. In this case, the μ changing unit 21 does not change the basic step-size parameter μ (step S104). Then, the process ends.

Operation and Effect of Embodiment

Next, a description will be given of an example of an operation and an effect of the active vibration noise control device 50 in the embodiment. Here, the active vibration noise control device 50 in the embodiment is compared with active vibration noise control devices in first and second comparative examples. The active vibration noise control device in the first comparative example actively controls the engine pulse by only using the speaker 10L installed on the front left side in the vehicle interior. Meanwhile, the active vibration noise control device in the second comparative example uses the speakers 10L and 10R which are installed on the front left side and the front right side, and switches the speaker to be used in accordance with the frequency of the engine pulse. Concretely, within the dip band, the active vibration noise control device in the second comparative example selects the speaker 10 by which the influence of the dip is small. The installation positions of the speakers 10 and the microphone 11 used in the embodiment, the first comparative example and the second comparative example are as mentioned above (see FIG. 2).

Figure 7:
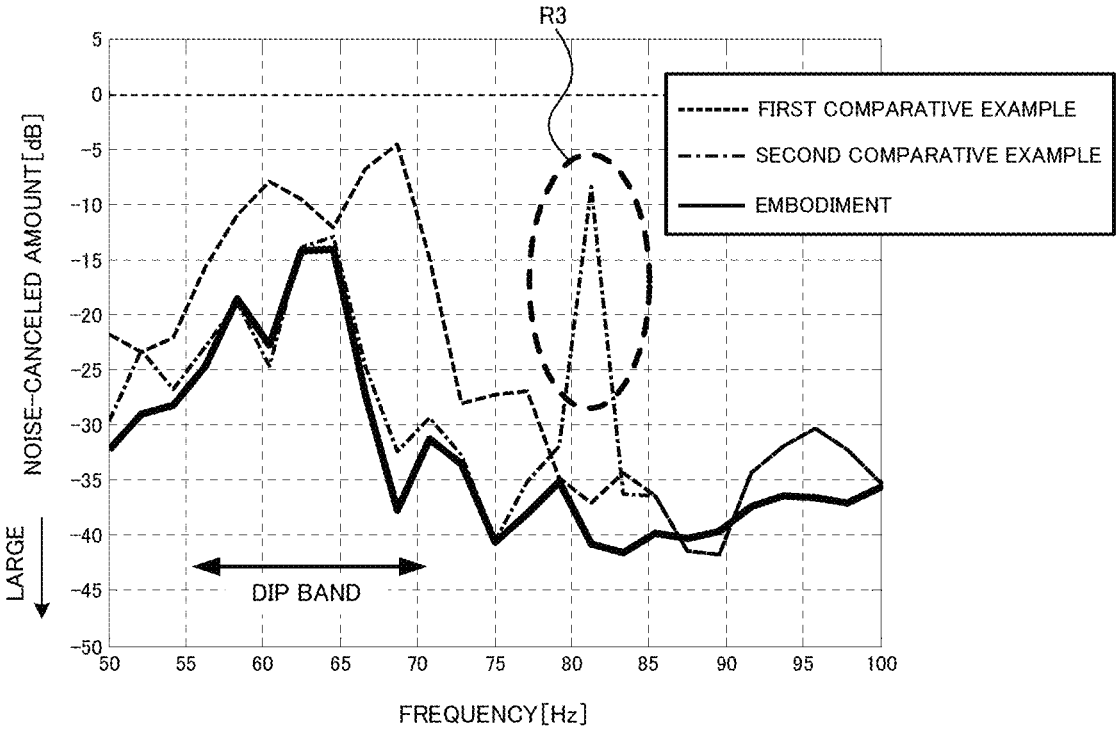
FIG. 7 shows a diagram for explaining an operation and an effect by an embodiment.

In FIG. 7, a horizontal axis shows a frequency [Hz], and a vertical axis shows a noise-canceled amount [dB]. Additionally, in FIG. 7, a solid line shows a noise-canceling effect by the active vibration noise control device 50 in the embodiment, and a broken line shows a noise-canceling effect by the active vibration noise control device in the first comparative example, and a dashed-dotted line shows a noise-canceling effect by the active vibration noise control device in the second comparative example. Here, results in case of using the artificial engine noise (sweep signal) from 40 [Hz] to 100 [Hz] are shown.

As shown in FIG. 7, according to the active vibration noise control device in the first comparative example, it can be understood that the decrease in the noise-canceling amount occurs in the dip band. In contrast, according to the active vibration noise control device in the second comparative example, it can be understood that the degree of the decrease in the noise-canceling amount in the dip band is smaller than that of the first comparative example. However, according to the active vibration noise control device in the second comparative example, as shown by a dashed area R3 in FIG. 7, it can be understood that the decrease in the noise-canceling amount occurs. It is thought that this is caused by the switch of the speaker 10. Concretely, it is thought that the increase in the error signal occurs due to a discontinuity of the phase change of the filter coefficient, during the switch of the speaker 10.

Meanwhile, according to the active vibration noise control device 50 in the embodiment, it can be understood that the decrease in the noise-canceling amount in the dip band is suppressed, similar to the second comparative example. Additionally, according to the active vibration noise control device 50 in the embodiment, it can be understood that the decrease in the noise-canceling amount like the second comparative example (see the dashed area R3) does not occur. This is because, since the active vibration noise control device 50 in the embodiment dose not switch the speaker 10 like the second comparative example (namely, all of the speakers 10L and 10R constantly operate), the phase discontinuity of the filter coefficient does not occur and the unnatural increase in the error signal does not occur.

Thus, according to the active vibration noise control device 50 in the embodiment, by delaying the update rate of the filter coefficient in the dip band, it is possible to appropriately suppress the decrease in the noise-canceling effect during the dip characteristics.

[Modification]

It is not limited that the present invention is applied to the active vibration noise control device 50 having two speakers 10L and 10R. Additionally, it is not limited that the present invention is applied to the active vibration noise control device 50 having one microphone 11. Furthermore, it is not limited that the present invention is applied to the active vibration noise control device 50, the speakers 10 and the microphone 11 of which are installed at the positions as shown in FIG. 2. The present invention can be applied to an active vibration noise control device having more than two speakers and/or more than one microphone, and can be applied to an active vibration noise control device, the speakers and the microphones of which are installed at various positions.

The above embodiment shows such an example that the process for dealing with the dip only for the path of the speaker 10L in the speakers 10L and 10R installed on the front left side and the front right side. Namely, the above embodiment shows such an example that, only for the path of the speaker 10L, the determination as to whether or not the frequency is in the dip band is performed and the step-size parameter μ is changed when the frequency is in the dip band. Hereinafter, a concrete description will be given of a method for determining the speaker in the plural speakers for which the process for dealing with the dip is performed.

As an example, the process for dealing with the dip can be performed only for the path of the speaker in the plural speakers in which the dip tends to occur. Concretely, only for the speaker in the plural speakers which has such amplitude characteristics that the amplitude characteristics of the transfer function are equal to or smaller than a predetermined value (corresponding to the threshold value used when the dip band is determined, for example), the determination as to whether or not the frequency is in the dip band is performed, and the step-size parameter μ is changed when the frequency is in the dip band.

Here, by examining a cause of the occurrence of the dip characteristics, a concrete example will be given of the path of the speaker in which the dip tends to occur, with reference to FIGS. 8A, 8B, 8C and 8D, FIGS. 9A and 9B and FIG. 10.

Figure 8A:
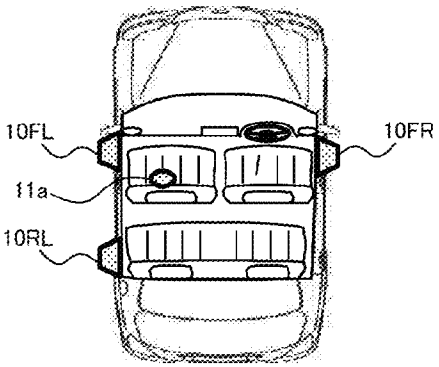
FIGS. 8A, 8B, 8C and 8D show other examples of transfer characteristics of paths.
Figure 8B:
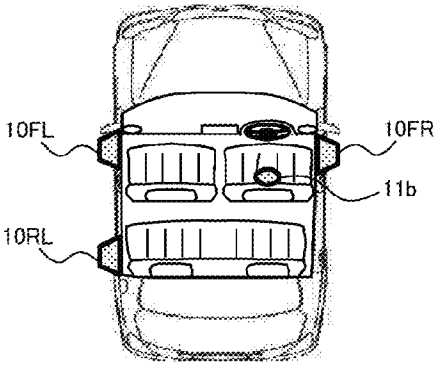

FIGS. 8A, 8B, 8C and 8D show examples in case of installing the speakers and the microphone at different positions from the above embodiment. Here, as shown in FIG. 8A, such an example that the speakers 10FL, 10FR and 10RL are installed on the front left side, the front right side and the rear left side in the vehicle interior and the microphone 11*a* is installed on the passenger's side is shown. Additionally, as shown in FIG. 8B, such an example that the speakers 10FL, 10FR and 10RL are installed on the front left side, the front right side and the rear left side in the vehicle interior and the microphone 11*b* is installed on the driver's side is shown. Hereinafter, the speaker 10FL is expressed as "FL", and the speaker 10FR is expressed as "FR", and the speaker 10RL is expressed as "RL". In addition, the microphone 11*a* is expressed as "E1", and the microphone 11*b* is expressed as "E2".

Figure 8C:
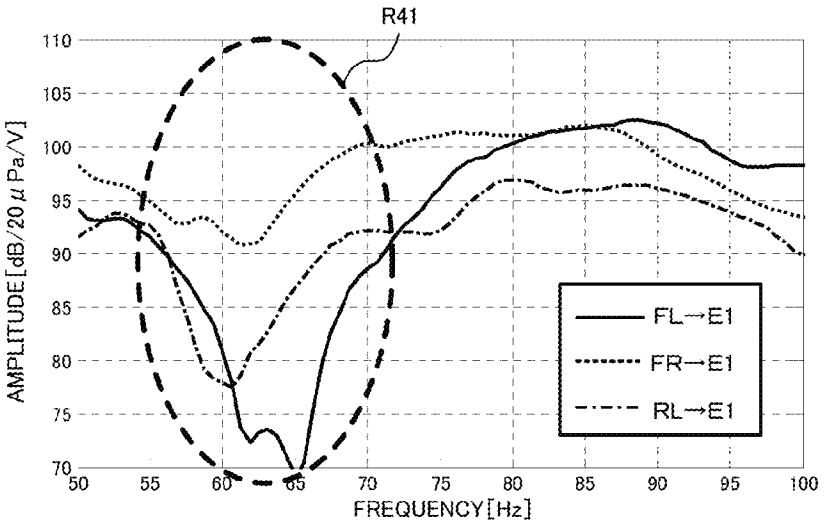

FIG. 8C shows examples of the transfer characteristics of the paths shown in FIG. 8A (the paths from the speakers 10FL, 10FR and 10RL to the microphone 11*a*). In FIG. 8C, a horizontal axis shows a frequency [Hz], and a vertical axis shows an amplitude [dB/20 μPa/V]. Additionally, a solid line shows transfer characteristics of a path (FL→E1) from the speaker 10FL to the microphone 11*a*, and a broken line shows transfer characteristics of a path (FR→E1) from the speaker 10FR to the microphone 11*a*, and a dashed-dotted line shows transfer characteristics of a path (RL→E1) from the speaker 10RL to the microphone 11*a*.

In a frequency band shown by a dashed area R41 in FIG. 8C, with regard to the path from the speaker 10FL to the microphone 11*a*, it can be understood that the significant decrease in the amplitude occurs. Namely, it can be said that the relatively large dip occurs. In contrast, with regard to the paths from the speakers 10FR and 10RL to the microphone 11*a*, it can be understood that the above significant decrease in the amplitude does not occur.

Figure 8D:
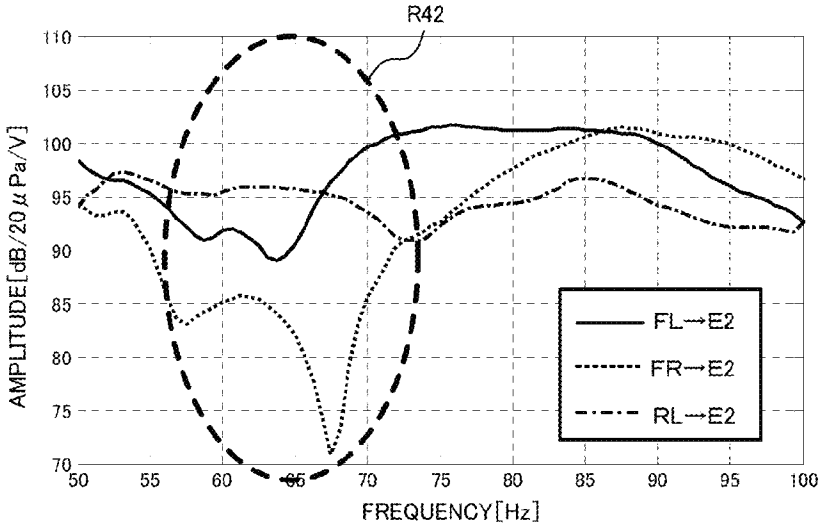

FIG. 8D shows examples of the transfer characteristics of the paths shown in FIG. 8B (the paths from the speakers 10FL, 10FR and 10RL to the microphone 11*b*). In FIG. 8D, a horizontal axis shows a frequency [Hz], and a vertical axis shows an amplitude [dB/20 μPa/V]. Additionally, a solid line shows transfer characteristics of a path (FL→E2) from the speaker 10FL to the microphone 11*b*, and a broken line shows transfer characteristics of a path (FR→E2) from the speaker 10FR to the microphone 11*b*, and a dashed-dotted line shows transfer characteristics of a path (RL→E2) from the speaker 10RL to the microphone 11*b*.

In a frequency band shown by a dashed area R42 in FIG. 8D, with regard to the path from the speaker 10FR to the microphone 11*b*, it can be understood that the significant decrease in the amplitude occurs. Namely, it can be said that the relatively large dip occurs. In contrast, with regard to the paths from the speakers 10FL and 10RL to the microphone 11*b*, it can be understood that the above significant decrease in the amplitude does not occur.

According to the results shown in FIGS. 8C and 8D, with regard to the path of the speaker 10 which is arranged adjacent to the microphone 11, it can be said that the relatively large dip occurs in the low frequency band.

Figure 9A:
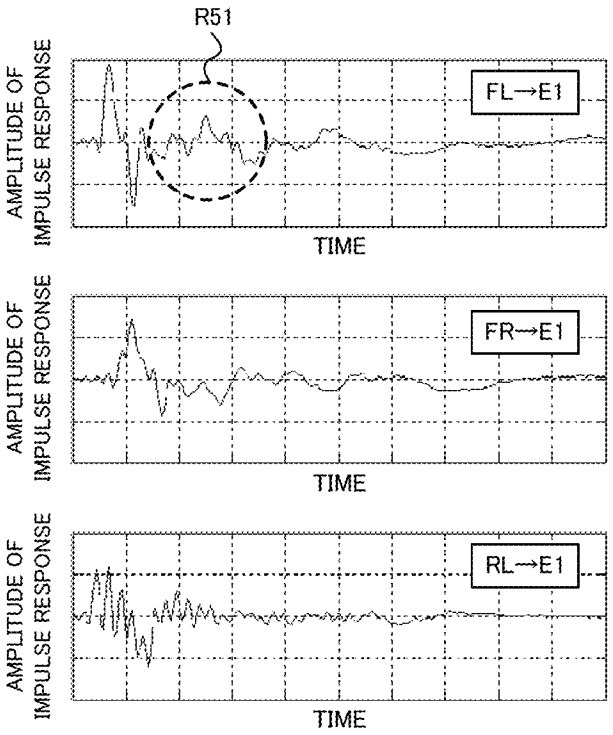
FIGS. 9A and 9B show examples of impulse responses.
Figure 9B:
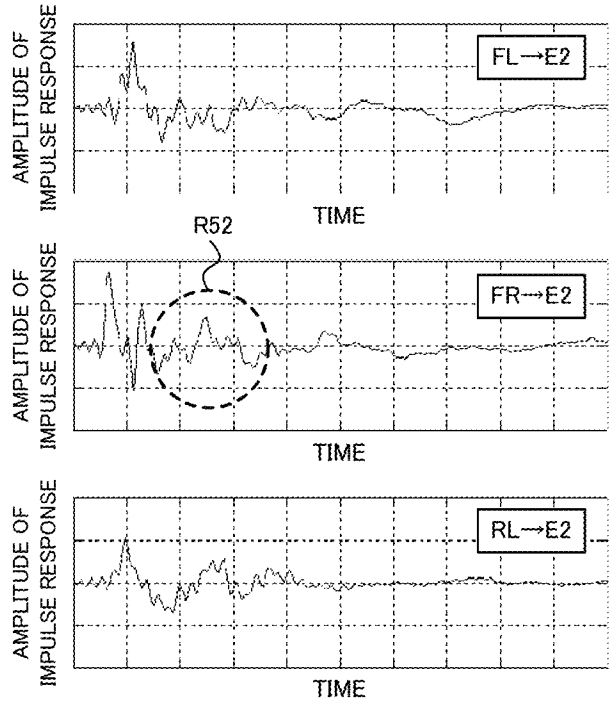

FIGS. 9A and 9B show examples of impulse responses (time waveforms) related to the paths shown in FIGS. 8A and 8B, respectively. In this case, an upper graph shows the impulse response related to the speaker 10FL, and a middle graph shows the impulse response related to the speaker 10FR, and a lower graph shows the impulse response related to the speaker 10RL. In FIGS. 9A and 9B, a horizontal axis shows time, and a vertical axis shows an amplitude of the impulse response.

As shown by a dashed area R51 in FIG. 9A, with regard to the path shown in FIG. 8A, it can be understood that a large reflected sound occurs in the path of the speaker 10FL. Additionally, as shown by a dashed area R52 in FIG. 9B, with regard to the path shown in FIG. 8B, it can be understood that a large reflected sound occurs in the path of the speaker 10FR.

According to the results shown in FIGS. 9A and 9B, with regard to the path of the speaker 10 which is arranged adjacent to the microphone 11, it can be said that the large reflected sound occurs. Here, a time difference between the reflected sound shown by the dashed areas R51 and R52 and a direct sound is about 0.008 [sec], and the time difference becomes a half wavelength at 62.5 [Hz]. Therefore, it is thought that the relatively large dip occurs at the above frequency, as shown in FIGS. 8C and 8D.

Figure 10:
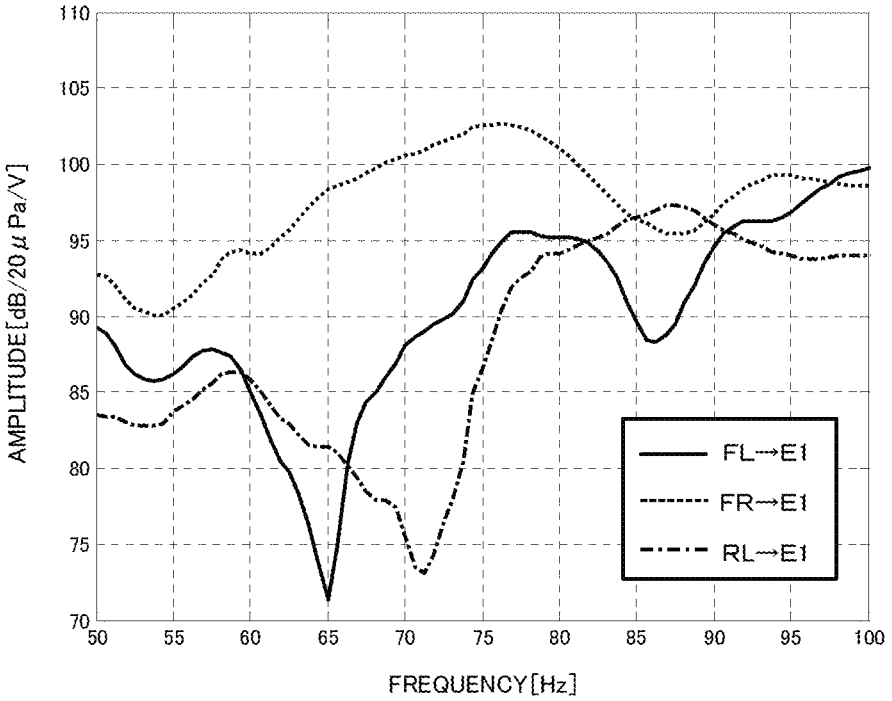
FIG. 10 shows still other examples of transfer characteristics of paths.

FIG. 10 shows examples of transfer characteristics of paths in case of using a different vehicle type from a vehicle type for which the measurement shown in FIGS. 8A, 8B, 8C and 8D is performed. Here, similar to FIG. 8A, such an example that the speakers 10FL, 10FR and 10RL are installed on the front left side, the front right side and the rear left side in the vehicle interior and the microphone 11*a* is installed on the passenger's side is shown.

In FIG. 10, a horizontal axis shows a frequency [Hz], and a vertical axis shows an amplitude [dB/20 μPa/V]. Additionally, a solid line shows transfer characteristics of the path (FL→E1) from the speaker 10FL to the microphone 11*a*, and a broken line shows transfer characteristics of the path (FR→E1) from the speaker 10FR to the microphone 11*a*, and a dashed-dotted line shows transfer characteristics of the path (RL→E1) from the speaker 10RL to the microphone 11*a*.

According to FIG. 10, with regard to the path from the speaker FL to the microphone 11*a*, it can be understood that the significant decrease in the amplitude occurs in the low frequency band. Namely, it can be said that the relatively large dip occurs. In contrast, with regard to the paths from the speakers 10FR and 10RL to the microphone 11*a*, it can be understood that the above significant decrease in the amplitude does not occur.

It can be said that the result shown in FIG. 10 is the same as the result shown in FIG. 8C. Therefore, it can be said that the dip characteristics are a common tendency in the vehicle interior space.

Thus, it is thought that the dip characteristics are caused by the reflected sound generated in the vehicle interior. Additionally, it is thought that the influence of the dip is large in the path of the speaker arranged adjacent to the microphone (namely, as for the speaker arranged adjacent to the microphone, the dip tends to occur), and that the influence of the dip is large in the low frequency band. Therefore, it is preferable that the process for dealing with the dip is performed only for the speaker in the plural speakers which is arranged adjacent to the microphone. Concretely, only for the speaker arranged adjacent to the microphone, it is preferable that the determination as to whether or not the frequency is in the dip band is performed, and that the step-size parameter μ is changed when the frequency is in the dip band.

It is not limited that the process for dealing with the dip is performed only for a path of one speaker in the plural speakers. The process for dealing with the dip may be performed for paths (including all paths) of more than one speaker in the plural speakers. In such a case that the process for dealing with the dip is performed for paths of more than one speaker, for these speakers, the dip bands used for the band determination are set, and the changed step-size parameters μ' (or the parameters for change α) are set. Namely, for these speakers, the different dip bands and the different changed step-size parameters μ' are used. In this case, the dip bands and the changed step-size parameters μ' can be determined by the same method as the above embodiment.

It is not limited that the present invention is applied to the vehicle. Other than the vehicle, the present invention can be applied to various kinds of transportation such as a ship or a helicopter or an airplane.

INDUSTRIAL APPLICABILITY

This invention is applied to closed spaces such as an interior of transportation having a vibration noise source (for example, engine), and can be used for actively controlling a vibration noise.

DESCRIPTION OF REFERENCE NUMBERS

10L, 10R Speaker
11 Microphone
13 Frequency Detecting Unit
14*a* Cosine Wave Generating Unit
14*b* Sine Wave Generating Unit
15L, 15R Adaptive Notch Filter
16L, 16R Reference Signal Generating Unit
17L, 17R w-Updating Unit
20 Band Determining Unit
21 μ Changing Unit
50 Active Vibration Noise Control Device

The invention claimed is:

1. An active vibration noise control device for canceling a vibration noise by making plural speakers output control sounds, comprising:

a basic signal generating unit which generates a basic signal based on a vibration noise frequency generated by a vibration noise source;

plural adaptive notch filters which generate control signals provided to each of the plural speakers by applying filter coefficients to the basic signal, in order to make the plural speakers generate the control sounds so that the vibration noise generated by the vibration noise source is canceled;

a microphone which detects a cancellation error between the vibration noise and the control sound, and outputs an error signal;

a reference signal generating unit which generates a reference signal from the basic signal based on transfer functions from the plural speakers to the microphone;

plural filter coefficient updating units which update the filter coefficients used by each of the plural adaptive notch filters based on the error signal and the reference signal so as to minimize the error signal;

a dip band determining unit which determines a dip band in which a transfer characteristic from the speaker to the microphone has a dip, based on amplitude characteristics of an output sound from the speaker;

a storage unit which stores the dip band determined by the dip band determining unit; and a step-size parameter changing unit which changes a step-size parameter used for updating the filter coefficient of one or more filter coefficient updating units in the plural filter coefficient updating units, wherein, when the vibration noise frequency is in the dip band stored in the storage unit, the step-size parameter changing unit changes the step-size parameter to a value smaller than a basic step-size parameter used when the vibration noise frequency is not in the dip band.

2. The active vibration noise control device according to claim 1, wherein, only for a speaker in the plural speakers which has such a frequency band that amplitude characteristics of the transfer functions are equal to or smaller than a predetermined value, the step-size parameter changing unit changes the step-size parameter for updating the filter coefficient used by the adaptive notch filter which generates the control signal of the speaker.

3. The active vibration noise control device according to claim 1, wherein, only for a speaker in the plural speakers which is arranged adjacent to the microphone, the step-size parameter changing unit changes the step-size parameter for updating the filter coefficient used by the adaptive notch filter which generates the control signal of the speaker.

4. The active vibration noise control device according to claim 1, wherein the step-size parameter changing unit sequentially compares amplitude information related to each of the transfer functions from the plural speakers to the microphone which is preliminarily stored for each frequency with a predetermined threshold value, and uses a frequency band in which the amplitude information is below the threshold value as the dip band.

5. The active vibration noise control device according to claim 1, wherein the step-size parameter changing unit uses a frequency band in which amplitude characteristics of the transfer functions are equal to or smaller than a predetermined value as the dip band.

6. The active vibration noise control device according to claim 1, wherein, with regard to amplitude characteristics of the transfer functions, the step-size parameter changing unit uses a value in accordance with a difference between an amplitude in the dip band and an amplitude in a frequency band other than the dip band as a changed value of the step-size parameter.

* * * * *